US008771004B2

(12) United States Patent
Fehling et al.

(10) Patent No.: US 8,771,004 B2
(45) Date of Patent: Jul. 8, 2014

(54) MINIATURE SPRING CLAMP

(75) Inventors: Stephan Fehling, Lage (DE); Walter Hanning, Detmold (DE); Dietmar Horn, Blomberg (DE); Constantin Classen, Detmold (DE); Juergen Ziemke, Detmold (DE); Michael Herrmann, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 85 days.

(21) Appl. No.: 13/701,742

(22) PCT Filed: Jun. 27, 2011

(86) PCT No.: PCT/EP2011/060676

§ 371 (c)(1),
(2), (4) Date: Dec. 3, 2012

(87) PCT Pub. No.: WO2012/000919

PCT Pub. Date: Jan. 5, 2012

(65) Prior Publication Data

US 2013/0072072 A1 Mar. 21, 2013

(30) Foreign Application Priority Data

Jun. 30, 2010 (DE) ..... 20 2010 009 666 U

(51) Int. Cl.
*H01R 4/04* (2006.01)

(52) U.S. Cl.
USPC ..... 439/441

(58) Field of Classification Search
USPC ..... 439/441, 439
See application file for complete search history.

(56) References Cited

U.S. PATENT DOCUMENTS

| | | | | |
|---|---|---|---|---|
| 2,713,668 | A * | 7/1955 | Gibilisco | 439/438 |
| 5,409,407 | A * | 4/1995 | Mizuno et al. | 439/860 |
| 5,494,456 | A | 2/1996 | Kozel | |
| 6,712,641 | B2 * | 3/2004 | Beege et al. | 439/441 |
| 7,104,833 | B2 * | 9/2006 | Oesterhaus | 439/441 |
| 8,251,738 | B2 * | 8/2012 | Heckert et al. | 439/441 |
| 8,408,952 | B2 * | 4/2013 | Wu | 439/861 |
| 2002/0155750 | A1 * | 10/2002 | Beege et al. | 439/441 |
| 2006/0063420 | A1 * | 3/2006 | Reibke et al. | 439/441 |

FOREIGN PATENT DOCUMENTS

| | | | |
|---|---|---|---|
| DE | 2503091 | A1 | 7/1976 |
| DE | 9309139.7 | U1 | 9/1993 |
| DE | 19613557 | A1 | 6/1997 |
| DE | 10253858 | B4 | 9/2004 |
| DE | 102007035336 | B3 | 2/2009 |

(Continued)

*Primary Examiner* — Gary Paumen
(74) *Attorney, Agent, or Firm* — Lawrence E. Laubscher, Sr.; Lawrence E. Laubscher, Jr.

(57) ABSTRACT

A spring terminal for connecting the bare end of a conductor with a bus bar, including an insulated housing containing a chamber defined by a pair of planar parallel spaced vertical side walls, and an orthogonally connected vertical end wall. Mounted in the chamber are a vertical bus bar adjacent the end wall, and a U-shaped clamping spring that biases toward clamped electrical engagement with the bus bar the bare end of a vertical conductor that is inserted downwardly into the chamber. The clamping spring includes a stationary lower leg portion fixed to the housing, a pivotable body portion, and an upper clamping leg portion that engages the conductor, a locking arrangement serving to lock the body portion to the housing when the spring is in the clamping condition.

8 Claims, 3 Drawing Sheets

(56) References Cited

FOREIGN PATENT DOCUMENTS

| | | | |
|---|---|---|---|
| DE | 202009010945 | U1 | 11/2009 |
| DE | 202008016856 | U1 | 6/2010 |
| DE | 102009004513 | A1 | 7/2010 |
| EP | 0831557 | B1 | 10/2000 |
| JP | 601131969 | U | 9/1985 |

* cited by examiner

MINIATURE SPRING CLAMP

REFERENCE TO RELATED APPLICATIONS

This application is a continuation of the International Application No. PCT/EP2011/060676 filed Jun. 27, 2011, which claims priority of German application No. DE 20 2010 009 666.0 filed Jun. 30, 2010.

BACKGROUND OF THE INVENTION

1. Field of the Invention

A spring terminal is provided for clamping the bare end of a conductor with a bus bar, including a housing containing a chamber in which is mounted a bus bar, a spring mounted in the chamber for clamping the bare end of the conductor in parallel contiguous relation to the bus bar, and a locking arrangement for locking the spring in the clamping condition.

2. Description of Related Art

There are spring terminals where a conductor is cramped on a motionless current-conducting bus bar by means of a mobile terminal body. As a rule, to adjust the terminal body, one uses a screw by means of which the terminal body is adjusted into its cramping position.

Such a spring terminal is shown, for example, by European patent No. EP 0 836 242 B1, where an electrical conductor can be clamped firmly with a movably positioned thrust piece. When the thrust piece is in the firmly clamped state, the conductor contacts a bus bar. A spring is provided to reset the thrust piece.

SUMMARY OF THE INVENTION

Accordingly, a primary object of the present invention is to provide a spring terminal for connecting the bare end of a conductor with a bus bar, including an insulated housing having a pair of planar parallel spaced vertical side walls and an orthogonally connected vertical end wall cooperating to define a chamber in which are mounted a vertical bus bar adjacent the end wall, and a U-shaped clamping spring that biases toward clamped electrical engagement with the bus bar the bare end of a vertical conductor that is inserted downwardly into the chamber, locking means being provide for locking the spring in the clamping condition.

According to a more specific object of the invention, the clamping spring includes a stationary lower leg portion fixed to the housing, a pivotable intermediate body portion, and an upper clamping leg portion that engages the conductor, the locking arrangement being operable to lock the spring body portion to the housing when the spring is in the clamping condition.

According to another object of the invention, the spring lower mounting leg portion is fixed to the housing by outwardly projecting mounting wing portions that extend into corresponding opposed mounting openings contained in the housing side walls, respectively.

According to further object of the invention, the spring body portion is locked to the housing by outwardly projecting locking wings that extend into opposed locking openings contained in the housing side walls, said locking openings being provided with a series of saw tooth projections that extend in spaced relation outwardly from the bus bar and the housing end wall.

Another object of the invention is to create a very space-saving spring terminal that can be produced at very reasonable cost and that can be used for very many conductor cross-sections and that at the same time is very easily assembled.

The problem is solved by a spring terminal with a contact bar for the electrical connection of a conductor that can be inserted in the spring terminal in an insertion direction with an electrical subassembly and with a clamping means for the purpose of clamping the inserted conductor in the spring terminal, whereby the clamped conductor contacts the contact bar electrically, whereby the spring terminal comprises a housing part that has two essentially mutually parallel-aligned leg surfaces, whereby the leg surfaces in each case have both a bearing means for positioning the clamping means as well as a locking means for locking the conductor against extraction that would be against the insertion direction.

The spring terminal can be made at very reasonable cost with a few parts because, according to the invention, the housing part comprises both the spring mounting means and the locking means.

In a preferred embodiment, the clamping means is provided resiliently so that it will retain the conductor in the inserted position. Because the clamping means is to be resilient, it adjusts itself automatically as the conductor is inserted. As a result, the spring terminal can be used for conductors with varying conductor cross-sections within a vast conductor cross-section range. Besides, a clamping means reset force thus acts upon the inserted conductor, and that force works in the direction of the conductor and counteracts any extraction of the conductor against the insertion direction.

Here, the clamping means is preferably so provided that it will lock the inserted conductor against extraction in the direction opposite to the insertion direction. As a result, the inserted conductor cannot be pulled out of the spring terminal without additional actuation means. The spring terminal therefore does not require any additional means, such as, for example, an adjusting screw in order so to set the clamping means so that it will securely clamp the conductor.

The housing part furthermore preferably comprises a lateral surface that is arranged laterally with respect to the leg surfaces and that connect them so that it essentially has a U-shape. Such a housing part can be made very quickly, at low cost, and with conventional means, for example, with a bent stamping part. It offers the advantage that it can be made with very slight production tolerances and a very great degree of stiffness.

Preferably, the bus bar extends inside the housing part along the lateral end wall surface, whereby the clamping means likewise preferably is arranged between the leg surfaces. In this arrangement, therefore, the contact of the contact rail to the inserted conductor as well as the clamping mechanism would be protected by the housing.

In a particularly preferred manner, the clamping means is arranged symmetrically with respect to a central plane that essentially extends parallel to the leg surfaces. In a similar manner, the clamping means is positioned and/or secured on the leg surfaces on both sides of the central plane. Because the clamping means is in this fashion symmetrically received in the housing part, the balance of forces in the housing part is preserved as the conductor is inserted.

In a particularly preferred embodiment, the leg surfaces in each case have a mounting window as part of the mounting means, whereby the clamping means on its mounting leg displays two bearing edge wing projections that are arranged symmetrically with respect to the central plane and with which the clamping means is positioned in the opposed mounting windows. When the clamping means is in the assembled state, the mounting wings extend into the mounting windows. In a likewise preferred embodiment, the clamping means is positioned with its mounting leg on the leg edges of the leg surfaces, which extend out of the leg surface in the direction of the clamping means. Comparing the embodiments, the positioning of the clamping means in the mounting windows is advantageous, on the one hand, because in this embodiment, the mobility of the clamping means is not hindered by the protruding mounting leg wings. Besides, in this embodiment, the clamping means cannot be shifted; instead, it is securely positioned in a locked manner.

In a further preferred embodiment, the leg surfaces in each case, as locking means, display at least one locking tooth, whereby the clamping means has two locking wings that are arranged symmetrically with respect to the longitudinal central plane. Preferably, the locking tooth of a leg surface in each case cooperates with a locking edge of the clamping means. In order not to hinder the mobility of the clamping means, there is an embodiment which is preferred in this case where the locking is arranged in a locking window of the leg surface as compared to a further embodiment where the securing tooth extends starting from the leg surface in the direction of the clamping means. In a particularly preferred manner, a series of locking teeth are provided in the locking windows order to lock an inserted conductor with varying conductor cross-sections against extraction. The locking edges are preferably arranged on the spring intermediate body portion.

In a preferred manner, the inserted conductor is arranged between the clamping means and the bus bar so that the clamping means will act directly upon the conductor.

In a further preferred embodiment, the clamping means is generally U-shaped and has a mounting leg for the purpose of positioning the spring and the clamping means, a clamping leg for the purpose of clamping the conductor, as well as an intermediate body portion that is connected to the leg of the clamping means, whereby the legs in each case are both arranged at an acute angle to the intermediate body portion. As the conductor is inserted, the acute angle between the clamping leg and the body portion decreases, whereby the acute angle between the mounting leg and the spring body portion grows larger. As a result as the conductor is inserted, the clamping means sidesteps roughly in a circular arc shape in the area of the corner between the clamping leg and the intermediate body portion, whereby the circular arc has a big circular radius. At its clamping leg, the clamping means preferably has a clamping edge that is provided for a form-locking contact with the conductor. The U-shape configuration of the cramping means makes it possible for this clamping edge to move almost horizontally independently of the conductor cross-section during the insertion of the conductor, and its position on the conductor will therefore not change as a function of the conductor cross-section.

To protect the spring terminal against the penetration of dust and/or moisture and at the same time to insulate it electrically toward the outside, the spring terminal preferably also includes an insulating outer casing. Arranged in the insulating casing are preferably the housing part, the clamping means, and partly also at least the bus bar. The insulation housing contains an insertion opening through which the conductor can be inserted into the spring terminal To be able to extract a conductor that has been inserted into the spring terminal out of the spring terminal, it is furthermore preferably so shaped that the clamping leg with the conductor inserted can be actuated by means of an actuation device, for example, the tip of a screwdriver, so that the conductor can be taken out of the spring terminal against the insertion direction.

In a particularly preferred manner, the spring terminal is made as a front terminal and/or as a terminal block. The inventive spring terminal offers the advantage that, although it can be made very small, it can be used for conductors with different conductor cross-section. Only three parts are needed for the contact as well as for the clamping of the conductor, that is, the housing part, the contact part, and the clamping means. All three parts can be made very cheaply as bent stamping parts, and the parts are very easily assembled. Besides, the storage costs for the spring terminal are very low because of the small number of parts. Finally, the spring terminal is very simple to operate.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
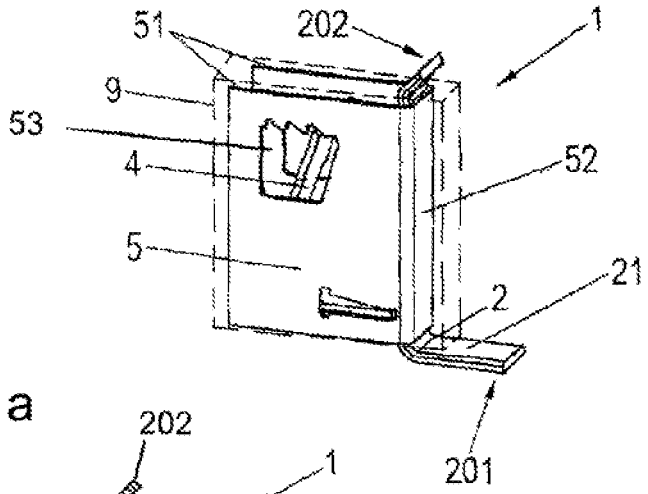
FIGS. 1*a* and 1*b* are perspective and longitudinal sectional views, respectively, of the spring terminal of the present invention.
Figure 1B:
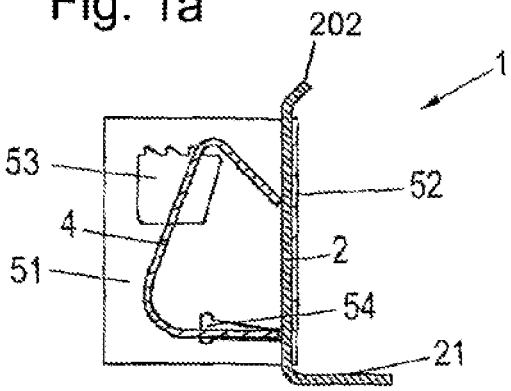
Figure 1C:
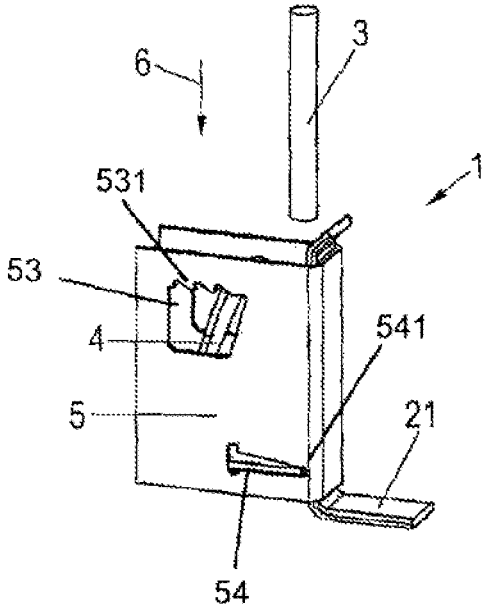
FIG. 1*c* is a perspective view illustrating the manner in which the bare end of a conductor is inserted downwardly into the housing chamber of the terminal of FIG. 1*a;*

Referring first more particularly to FIGS. 1*a*-1*c*, the spring terminal 1 includes a U-shaped housing 5 formed of electrically insulating synthetic plastic material and having a pair of parallel spaced vertical side walls 51, and a vertical orthogonally arranged end wall 52. Arranged in the housing chamber are a vertical bus bar 2 adjacent the housing end wall, and a generally U-shaped clamping spring 4. The housing side walls contain an opposed pair of locking openings 53, and an opposed pair of mounting openings 54. The bus bar 2 is generally L-shaped and includes a horizontal foot connecting portion that extends outwardly beyond the housing end wall 52. As will be explained in greater detail below, the clamping spring 4 is generally U-shaped and includes an intermediated body portion 41, a generally horizontal lower mounting leg 42, and an upper clamping leg portion 43. The top of the housing is open to permit the downward insertion of the bare end of a conductor 3 into the chamber defined within the housing adjacent the bus bar 2, as shown by the arrow 6. A series of locking teeth 531 are arranged in the locking windows 53, as will be described in greater detail below.

The vertical bus bar 2 is generally L-shaped and is provides at its upper end with a bent portion 202 that protrudes from the housing 5. At its lower end, the bus bar terminates in a horizontal tongue portion 21 that is adapted for electrical connection with an associated component. Spring terminal 1 furthermore is arranged in a protective insulation casing housing 9 that is shown schematically in FIG. 1*a*.

Figure 2A:
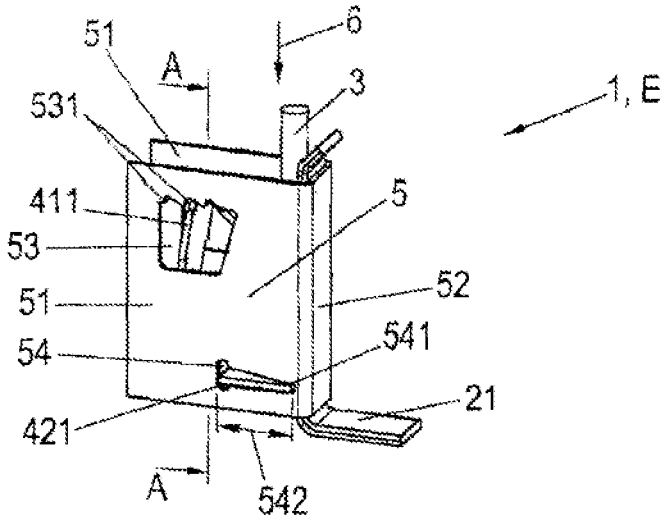
FIGS. 2*a* and 2*b* are perspective and sectional views, respectively, of the spring terminal with the conductor bare end inserted therein.
Figure 2B:
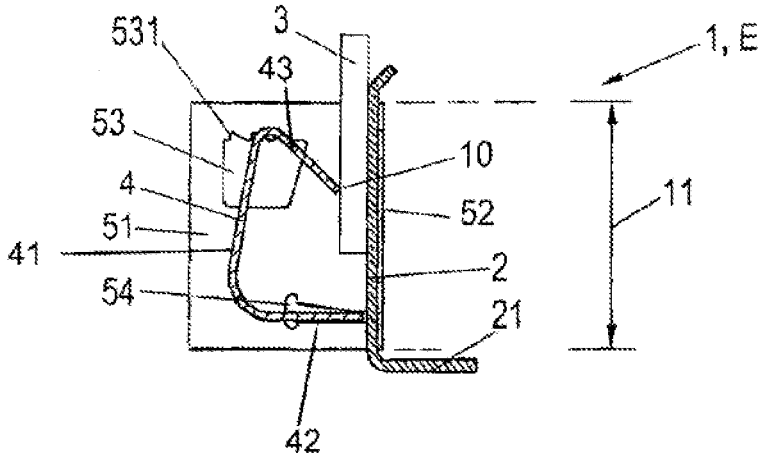

Referring now to FIGS. 2*a* and 2*b*, when the bare end of the vertical conductor 3 is introduced downwardly into the housing chamber as shown by the arrow 5, it is guided by the bent portion 202 of the bus bar 2 until the lower extremity of the conductor engages the upper surface of the spring upper clamping leg 43. The body portion 41 is pivotally deformed to away from the bus bar, and the free extremity 431 of the clamping spring leg 43 comes into clamping engagement with the outer circumferential surface of the conductor at the clamping location 10, as shown in FIG. 2*b*. It will be seen that the height 11 of the housing of the compact miniature spring terminal is relatively small.

Figure 3A:
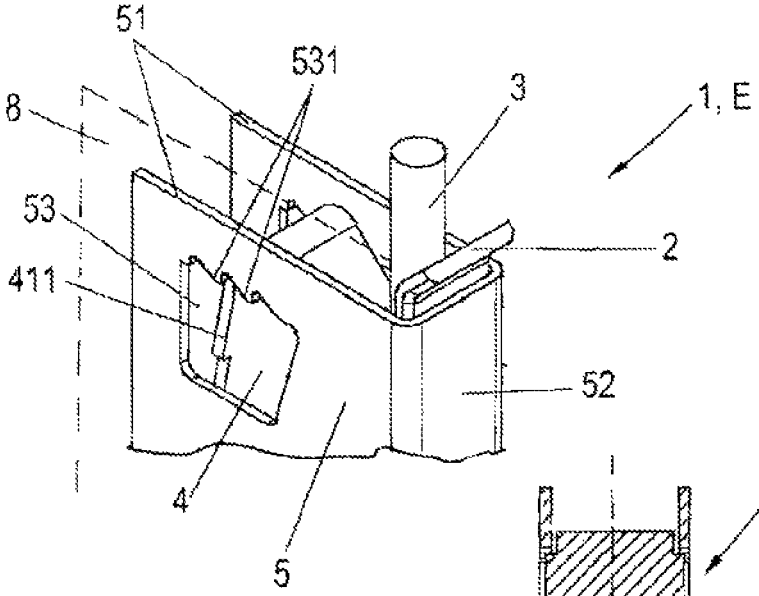
FIG. 3*a* is a detailed top perspective view of the apparatus of FIG. 2*a;*
Figure 3B:
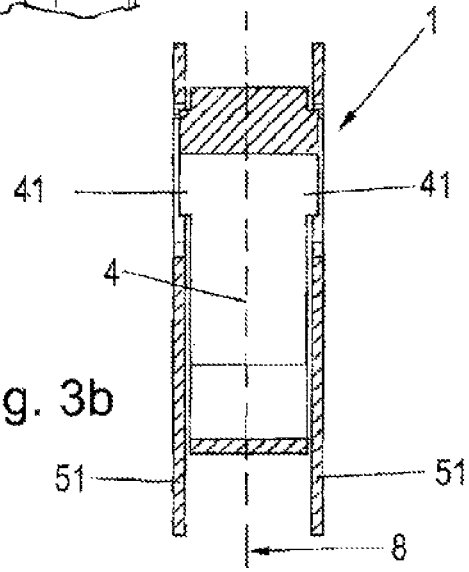
FIG. 3*b* is a transverse sectional view of the apparatus of FIG. 3*a* taken along the line A-A of FIG. 2*a*.

The clamping means 4 is positioned symmetrically with respect to the vertical longitudinal central plane 8 (see FIG. 3) in housing part 5, and includes two mounting wings 421 that are arranged symmetrically to central plane 8 and which extend in a coplanar manner from opposite sides of the spring mounting leg 42 into opposed mounting windows 54 contained in the side walls 51. The mounting windows 54 are generally V-shaped, so that clamping means 4 can pivot slightly around the acute end 541 of the V-shaped mounting window 54. On the other hand, the mounting wing 421 extends over an entire width 542 (FIG. 2*a*) of the mounting window 54, thereby to prevent any shifting of the clamping means 4 laterally with respect to insertion direction 6.

The clamping means 4 furthermore has two locking wings 411 that are arranged symmetrically with respect to the central plane 8 and that in each case extend in a coplanar manner into the opposed locking windows 53 contained in the housing side walls 51. Upon extraction of the inserted conductor 3 against the insertion direction 6, the upper edges of the locking wings engage the locking teeth 531 that are formed in the horizontal upper edge of the locking window 53.

Figure 4A:
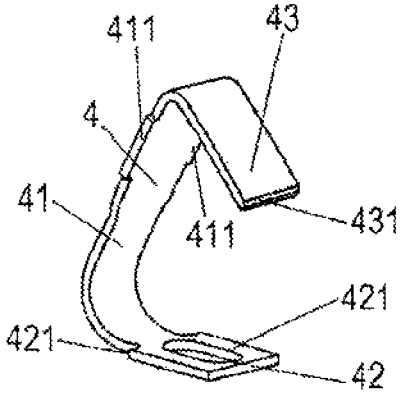
FIGS. 4*a* and 4*b* are perspective and sectional views, respectively, of the spring member of FIG. 2*b*.
Figure 4B:
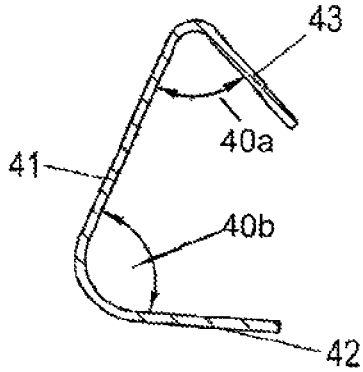

Referring to FIGS. 4*a* and 4*b*, the clamping means 4 is generally U-shaped and includes a cramping leg 43, a mounting leg 42, and an intermediate body portion 41 that connects the mounting and clamping legs. Here, both cramping leg 43 and mounting leg 42 are arranged at acute angles 40*a* and 40*b*, respectively, with respect to the spring body portion 41.

The two mounting wings 421 are arranged symmetrically with respect to central plane 8 (see FIG. 3) and in a coplanar manner with mounting leg 42. Furthermore, two locking edges 411 are arranged symmetrically with respect to central plane 8 in a coplanar manner on the body portion 41. Finally, clamping leg 43 has a cramping edge 431 by means of which it rests upon the inserted conductor 3 in a form-locking manner and cramps the latter.

As conductor 3 is inserted into spring terminal 1, the acute angle 40*a* between cramping leg 43 and connecting strut 41 becomes smaller and the acute angle 40*b* between bearing leg 42 and connecting strut 41 grows bigger so that clamping means 4 sidesteps essentially along a circular arc, and so that clamping means 4 is stressed.

As a result, a reset force of the cramping means 4 acts upon the inserted conductor 3, which force retains conductor 3 in its insertion position E.

The circle arc (not shown) has a big radius (not shown); therefore, clamping edge 431 moves along a straight line independently of the conductor cross-section of the inserted conductor 3 so that its position 10 with relation to height 11 (see. FIG. 2*b*) of housing part 5 will almost not change as a function of the conductor cross-section.

As conductor 3 is withdrawn against the direction of insertion 6, clamping means 4 is pivotally raised about pivot point 541 until the upper edge of each locking wing 411 rests against one of the associated securing teeth 531. Conductor 3 is now clamped on clamping edge 431 so that it will be secured against extraction.

Conductor 3 can be removed from spring terminal 4 with the help of an actuation means (such the tip of a screwdriver, as not shown) by means of which clamping leg 43 can be so bent that the acute angle 40*a* between cramping leg 43 and body portion 41 will get smaller.

While in accordance with the provisions of the Patent Statutes the preferred forms and embodiments of the invention have been illustrated and described, it will be apparent to those skilled in the art that changes may be made without deviating from the invention described above.

What is claimed is:

1. A spring terminal for connecting the bare end of a conductor (3) with a bus bar, comprising:

(a) a housing (5) formed of insulating material, said housing including a pair of parallel spaced planar vertical side walls (51), and a vertical end wall (52) connected orthogonally between corresponding vertical edges of said side walls, said end and side walls cooperating to define a chamber;

(b) a vertical bus bar (2) arranged in said chamber in engagement with said end wall, said housing having at its upper end an opening for receiving the bare end of a vertical conductor that is inserted downwardly into said chamber adjacent said bus bar; and (c) spring means for biasing the conductor bare end toward contiguous electrical engagement with said bus bar, said spring means including a generally U-shaped resilient metal spring (4) having:

(1) a generally vertical body portion (41);

(2) a generally downwardly inclined upper clamping leg portion (43) connected at a first acute angle (40*a*) with the upper end of said spring body portion, said clamping leg portion terminating at its free end in an end extremity (431);

(3) a generally horizontal lower mounting leg portion (42) connected at a second acute angle (40*b*) with the lower end of said spring body portion, said clamping leg portion and said mounting leg portion extending from said spring body portion in the direction of said bus bar;

(4) spring mounting means (54; 421) for mounting said spring within said housing chamber in a released condition in which:

(a) said mounting leg portion is fixed between said side walls;

(b) the spring body portion is free for pivotal displacement relative to said mounting leg portion;

(c) the free extremity (431) of said clamping leg is adjacent said busbar; and (d) the downwardly inclined upper surface of said clamping leg is so arranged that as the conductor is progressively inserted downwardly into said chamber, the conductor extremity engages said spring upper clamping leg and pivots said spring body portion relative to said mounting leg portion away from said bus bar toward a clamping position in which said clamping leg extremity engages the conductor circumferential surface and presses the conductor toward engagement with said bus bar; and (5) locking means for locking said spring body portion in said clamping position.

2. A spring terminal as defined in claim 1, wherein said spring connecting means comprises a pair of mounting wings (421) that project in a coplanar manner from opposite sides of said spring mounting leg portion into corresponding mounting openings (54) contained in said housing side walls, respectively.

3. A spring terminal as defined in claim 2, wherein said spring mounting leg portion is supported by said spring connecting means such that the free extremity of said mounting leg portion is in engagement with said bus bar.

4. A spring terminal as defined in claim 2, wherein said locking means comprises a pair of locking wings (411) that project in a coplanar manner outwardly from opposite edges of said spring body portion into corresponding locking openings (53) contained in said housing side walls, respectively.

5. A spring terminal as defined in claim 4, wherein each of said locking openings contain a plurality of locking projections (531) arranged in progressively spaced relation relative to said bus bar, the upper edges of said locking wings being arranged for engagement with said projections, thereby to effect locking of said spring member in a clamping position corresponding with the diameter of the conductor.

6. A spring terminal as defined in claim 5, wherein said locking projections comprise an arrangement of saw teeth.

7. A spring terminal as defined in claim 6, wherein said mounting openings (54) are triangular and have apices (541) adjacent said bus bar; and further wherein the lengths of said mounting wings (421) correspond with the lengths (542) of said mounting openings, whereby upon displacement of the conductor in the withdrawal direction relative to said housing, said spring is pivoted about said pivot apices to cause the upper edges of said locking wings extend into locking engagement with said saw teeth.

8. A spring terminal as defined in claim 7, wherein said spring mounting means and said spring locking means are symmetrically arranged relative to the vertical plane (8) that passes centrally between said spring side walls.

* * * * *